US006422883B1

(12) United States Patent
Cools

(10) Patent No.: US 6,422,883 B1
(45) Date of Patent: Jul. 23, 2002

(54) TRIGGER ACTIVATED EJECTING SYSTEM FOR ELECTRICAL PLUGS

(76) Inventor: Piet Leopold Margriet Cools, Roeselaarseweg 48, 8820 Torhout (BE)

( * ) Notice: Subject to any disclaimer, the term of this patent is extended or adjusted under 35 U.S.C. 154(b) by 0 days.

(21) Appl. No.: 09/826,331

(22) Filed: Apr. 4, 2001

(51) Int. Cl.[7] ..... H01R 13/60
(52) U.S. Cl. ..... 439/160
(58) Field of Search ..... 439/180, 676, 439/588, 589, 354, 270, 102, 265, 324, 159, 160

(56) References Cited

U.S. PATENT DOCUMENTS 2,696,594 A * 12/1954 Harrington et al. ..... 439/160
3,676,831 A * 7/1972 Bergwall ..... 439/270
3,737,835 A * 6/1973 Clement et al. ..... 439/160
3,786,392 A * 1/1974 McDaniel ..... 439/270
3,792,411 A * 2/1974 Jenkins ..... 439/270
RE28,545 E * 9/1975 Harris ..... 439/159
3,926,494 A * 12/1975 Maillaro ..... 439/159
3,958,849 A * 5/1976 Blairsdale ..... 439/270
5,082,450 A * 1/1992 Warren, Sr. et al. ..... 439/102
5,249,976 A * 10/1993 Brock ..... 439/102
5,266,040 A * 11/1993 Merill et al. ..... 439/159
5,480,314 A * 1/1996 Campbell ..... 439/159
6,050,837 A * 4/2000 Duhe, Jr. ..... 439/270

* cited by examiner

*Primary Examiner*—Neil Abrams
*Assistant Examiner*—J. F. Duverne
(74) *Attorney, Agent, or Firm*—Donn K. Harms

(57) ABSTRACT

A electrical plug ejecting system for use in combination with a an electrical plug attached to a cord, which cooperatively engages an electrical socket. The ejection system may be located inside the conventional male or female electrical fitting which is operatively attached at the end of a communicating cord. Ejection is accomplished by pulling on a trigger which laterally translates a rod inside the electrical fitting to separate the electrical fitting from frictional engagement with any attached electrical fitting configured for such operative attachment. The device may also function as an interface between male and female electrical fittings both at the end of a chord by having male and female configured sides on the interface for cooperative engagement with other fittings so configured. In this embodiment the rod translates toward and protrudes from one of the male or female configured sides to detach any electrical fitting thereon frictionally engaged.

10 Claims, 2 Drawing Sheets

TRIGGER ACTIVATED EJECTING SYSTEM FOR ELECTRICAL PLUGS

BACKGROUND OF THE INVENTION

1. Field of the Invention

Figure 1B:
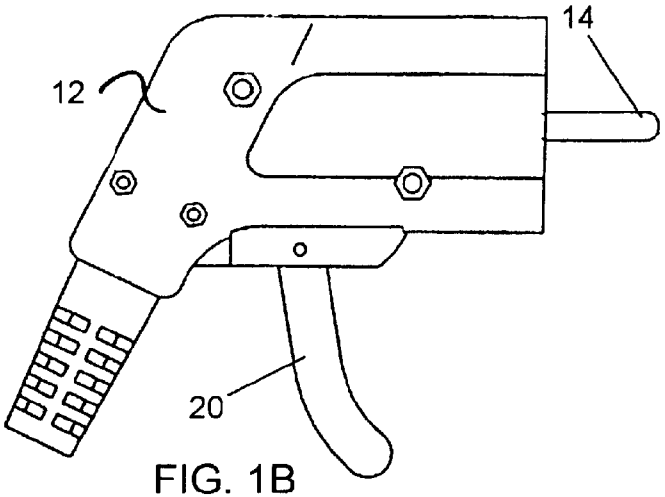

The invention relates to electrical plugs used in household and/or in industrial applications. More particularly, it relates to an electrical plug having a trigger activated ejection system to separate the male plug from the female plug socket.

2. Prior Art

All over the world, electrical connections between apparatus which are powered by electrical current and power grid communicating electrical power from the electrical power suppliers, are being made by means of electrical plugs. In many cases, the disconnection between a male and a female electrical plug is not so easy due to a variety of different reasons. Sometimes the wall contacts can come loose when pulling too hard on the male plug. In other cases, people pull directly on the cable attached to the plug and by consequence the plug, the cable or the wall contact can be damaged. Damaged electrical connections, especially when dealing with the 110 volt or 220 volt supply on a conventional power grid, can be the origin of dangerous situations to anyone coming in contact with them since the connections are not properly electrically insulated anymore. In the case of a conventional wall socket that receives a plug from a supply wire, when it comes loose it is in most cases very difficult to fit it perfectly back into its housing.

Additional problems are encountered by disabled people, older people and children who lack the muscular strength to disconnect the frictional engagement of the male plug engaged with the female socket and may therefor embark on an unsafe way of electrical disconnection of plugs using other manner of disengagement.

In most industrialized countries there are strict rules and building code requirements for the manufacture and sale of electrical plugs which require a tight frictional engagement between the plug and socket in an insulated cooperative engagement. While the connection and disconnection between a male and a female plugs which are properly manufactured and used should go smoothly, in many buildings there are always one or more plugs that presents a problem. Generally, the problem will lie in the disconnection of the male and female plug that have been engaged. Disengagement is usually harder to accomplish than engagement. This is because engagement allows the user to simply grip the male plug and lean their body weight into it as it lines up with the female sockets which register with the protruding male pins. However, once so engaged, the pins are frictionally held in place inside of the sockets and the user must grip the plug and use only body strength to pull the plug and socket apart without the benefit of using body weight and leverage.

Currently, there are no solutions to resolve that problem properly. Some manufacturers added a rotating system into the male plug to disconnect their engagement with the socket but this system still needs a lot of muscular strength on the part of the user. Other ideas involved a pushing system incorporated into the male plug but they twist the plug and the system was not electrically separated from the rest of the plug.

As such, there exists a need for an easily operated and inexpensively manufactured mechanical device that will facilitate the separation of engaged plugs and sockets. Such a device should provide a mechanical advantage to aid in the separation of the plug and socket and be useable by children and the elderly. Such a device should be easy to mechanically operate and should function in such a manner as to be easily incorporated into conventional socket and plug receptacle already in use and approved for such use.

SUMMARY OF THE INVENTION

The device herein described and disclosed provides a solution to the problem of disengagement of engaged plugs and sockets such as conventional A.C. household and industrial plugs and sockets, by adding an ejecting system that can be integrated into any electrical plug and socket style system, and is especially applicable however to the conventional AC household and industrial systems using plugs that engage with wall mounted or chord mounted female sockets. In the case of a conventional wall socket of the female style construction using a male plug, the addition of a trigger activated ejection pin into the male plug allows the user to simply squeeze the trigger to laterally translate the ejection pin into the socket and separate the plug and socket. In the case of chords having male and female terminators at their ends, the trigger activated ejection pin could be located in either the male or female receptacle and would be activated in the same manner. Of course placement in the male plug allows the plug to be engaged with either a wall socket or a socket on a chord and still provide the separation ability of the ejection pin.

An object of this invention is to provide for an easily operated device that will allow the user an aid in the separation of engaged plugs and socket receptacle.

Another object of this invention is to provide such a device that operates in a fashion to allow it to be encompassed into conventional sockets and plugs now approved for use in countries throughout the world without requiring reconfiguration of those plugs and sockets.

A further object of this invention is the provision of a device for separation of engaged plugs and sockets that may be interfaced in-between already installed sockets and plugs used therein.

Further objects of the invention will be brought out in the following part of the specification, wherein detailed description is for the purpose of fully disclosing the invention without placing limitations thereon.

BRIEF DESCRIPTION OF DRAWING FIGURES

Figure 1:
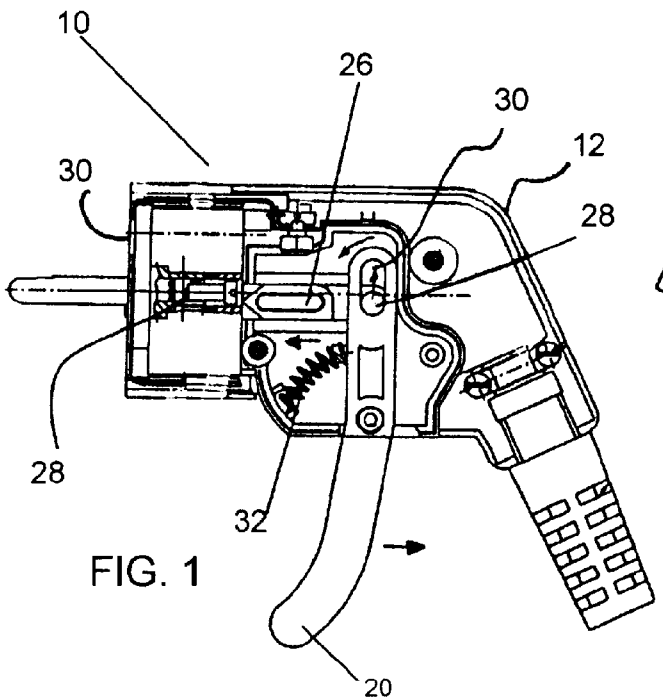

FIG. 1 is a cut away side view of an embodiment of the device disposed into a male electrical plug.

Figure 1A:
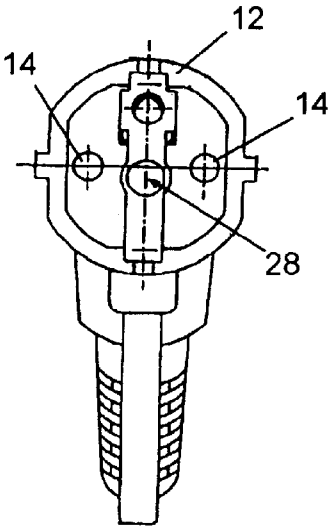

FIG. 1*a* is and end view of the device of FIG. 1.

FIG. 1*b* is an opposite side view of the device of FIG. 1.

Figure 2B:
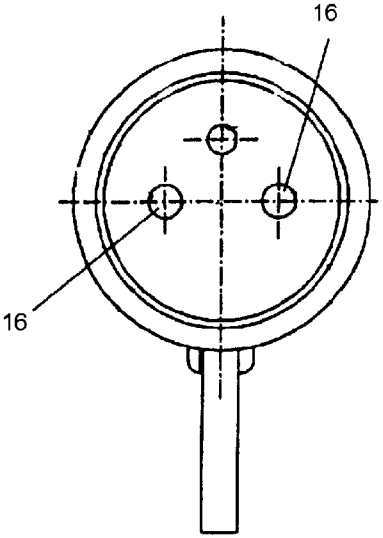
Figure 2:
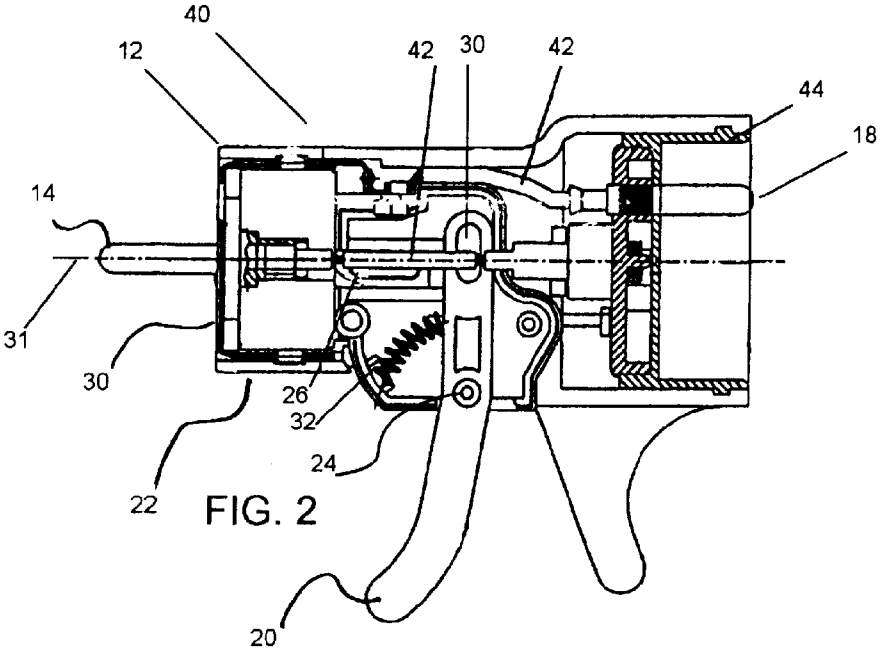

FIG. 2 is a side cut away view of an other embodiment of the disclosed device integrating the ejecting system using an adaptor to fit between existing male and female connections.

Figure 2C:
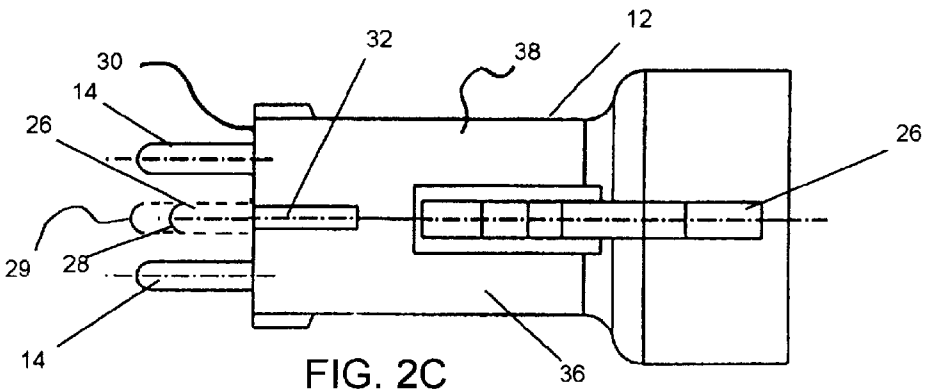
Figure 2A:
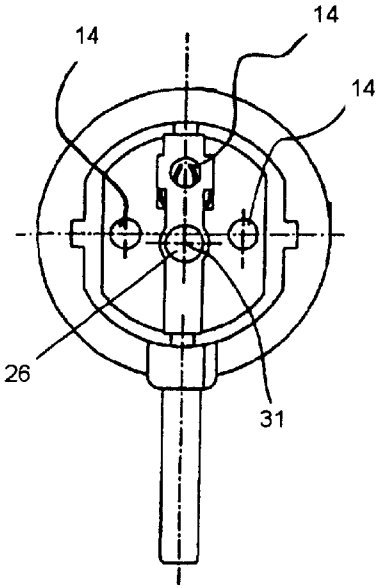

FIG. 2*a* is an and view of FIG. 2.

FIG. 2*b* is an opposite end view of FIG. 2*a*.

FIG. 2*c* a top view of FIG. 2 depicting the conventional two half construction of the body of plug and socket receptacle.

DETAILED DESCRIPTION OF THE PREFERRED EMBODIMENTS OF THE INVENTION

The device 10 as depicted in FIG. 1 is an ejecting system incorporated into a conventional male electrical plug 12 so that users can easily remove the plug 12 out of conventional frictional engagement of the plug pins 14 out of their conventional engagement with the pin receiving sockets 16 of a conventional female style socket 18. Disengagement of the frictionally engaged plug 12 with the socket 18 is easily achieved by pulling the trigger 20 backwards or away from the plug pins 14 of FIG. 1.

The ejecting system device 10 whether disposed in a male plug 12 or female receptacle 18 or an interface component embodiment 22, consists of a trigger 20 that articulates around a pivot 24 and is and operatively connected to laterally translate a center mounted push rod 26 by a sliding transmission 28 which consists of an elliptical aperture 30 in the upper end of the trigger 20 slidably engaged with a post 30 which is in operative communication the push rod 26.

In order to keep the push rod 26 retracted when the plug 12 is out of the contact with the receptacle 18, and also once mounted in frictional engagement therewith, a biasing means such as a spring 32, continually biases the trigger 20 and communicating push rod 26 to the retracted-position depicted in FIG. 1. When the trigger 26 is pulled by the user however the push rod 26 laterally translates to an extended position 29 as depicted in phantom in FIG. 2, with the distal end 28 opposite the attachment end at the trigger 20, protruding to the exterior of the front face 30 of the plug 12. When so operated of course, it causes the push rod 26 to push upon the face of the receiving receptacle 18 whether it be wall mounted or chord mounted, and separate the frictional engagement of the two. Once so separated, releasing the grip on the trigger 20 will cause the push rod 26 to bias to the retracted position.

The transmission 28 communicating between the push rod 26 and the trigger 20 converts the rotating movement of the trigger 20 into a lateral translation of the push rod 26 along the center axis 32 of the plug 12 or in the case of the female receptacle 34. Lateral translation along the center axis 32 places the push rod 26 substantially centered between along gives the advantage that the pushrod can be guided out of interference with any of the plug pins 14 or receiving sockets 16 and in between the plastic components making up the plug 12 to ensure enough rigidity to the trigger 20. Further, the mechanical advantage provided by the lever action of the trigger 20 to laterally translate the push rod 26 to the extended position protruding from the face 30 requires only a relative small force applied onto the trigger 20 to place the push rod 26 to the extended position past the face. Thus a user who is not strong such as a child or elderly person can operate the device 10 and the plug 12 comes very easily out of the frictional engagement with the female receptacle 18 whether it be mounted in a wall surface or on the end of another chord. By choosing the correct length of the trigger 20 that creates the momentum and the positioning of its pivot, you can create a pushing force of the laterally translating push rod as desired. An increased force might be necessary for plug and receptacle engagements that have multiple pins 14 engaged with multiple receptacle 16 such as 5 pin plugs which are very hard to disconnect.

The second advantage of using a translation system is that the push rod 26 can be integrated operatively into the middle section of any conventional plug 12 between the charged contact pins 14 so that the push rod 26 enables the plug 12 to be pushed out perpendicular from the frictionally engaged receiving sockets 16 female receptacle 18. Consequently, the plug 12 itself is never twisted or torqued around the contact pins 14 or the armature of the plug 12 as now happens with a stuck or heavily engaged plug 12 engaged with a female receptacle 18. Instead, the push rod 26 simply pushes the plug 12 backwards by using the female wall plug 18, or any other female plug, as a push back. Avoiding this twisting and misuse of the plug 12 will keep the female socket 18 mounted in the wall from coming loose form such mistreatment. Further, since no pull force is thus exerted on the female socket 18 as would be the case if the plug were normally disengaged, the mount of the female socket 18 in a wall is maintained.

As noted, a further advantage of the design of the ejecting system using the laterally translating push rod 26 is that it can easily be incorporated in any conventional model of electrical plug used in the United States, Europe, or elsewhere in the world. As shown on the drawings, the complete ejecting system is incorporated between two plates 36 and 38 which make up a conventional plug and exits between the pins 14 when used to force the plug 12 from the female receptacle 18. This enables a complete independent functioning of the ejecting system and the electrical connections, allowing the device to be incorporated easily for manufacture and without violating any safety standards applied in the different countries.

While FIG. 1 shows the integration of the device 10 into a European male electrical plug 12 with central and side contact grounds, the device 10 is easily adaptable to such plugs as approved in the United States and other countries. Since the device is plastic and a non conductor, the used materials can be the same as for the standard plugs such as nylon, ABS, or other plastics as required by local specific safety regulations.

The parts making up the plug 12, generally two halves of a body, can be assembled by normal techniques of welding, gluing, clipped engagement, or similar means of attachment. The ejecting plug can be used as a standard plug on any apparatus, and the system does not depend on any specific model of electrical plug. For any practical use, the dimensions will have to be chosen in function of the local requirements of the country that wishes to incorporate the system. How that the system is integrated will also depend on the plug model which will be used. The above system can also be integrated into the female side of an electrical plug in exactly the same way as described for the male 21 plug. Also heavy duty industrial plugs can integrate the ejecting system.

FIG. 2 shows another application of integrating the ejecting system using an adaptor 40 embodiment having at one end the plug 12 and at the other end, the female receptacle 18 operatively communicating with the plug 12 and configured to fit between existing male and female connections on chords or the like. Here the ejecting system has been integrated into an adaptor 40 as described above where the push rod 26 projects from the face of the male side when triggered, and has a female receptacle integrated at the opposite side. This adaptor 40 embodiment combining the plug 12 and receptacle 18 can then be placed in between an existing male and female connection to aid in separating the connection there between. The shown model is with central ground pin but it can be applied on any kind of female plug. The pins 14 of the male end communicate with the correct respective receiving sockets 16 of the female end using internally mounted conventional wires 42. The gauge of the wires 42 are of course chosen to comply with local safety regulations. The shown model optionally incorporates the child protection system 44 as required in some European countries. The advantage of the adaptor 40 embodiment is that it easily attaches to the male end of any chord and to a wall socket eliminating the need for any tools to retrofit the chord attachment.

In the adaptor, both the ejecting system and the electrical connection pins 14 are completely separated so that the adaptor can meet again all safety requirements for use of electrical plugs 12. Since the two plates 36 and 38 making up the plug body are sealed and cooperatively engaged, the complete system is safe for use.

This idea of integrating an ejecting system into an electrical plug 12, or adaptor 40 can be produced for any electrical system and the ejection system described herein can also be fitted to the female receptacle 18 in the same manner as described above for the male plug 12 with the push rod 26 centered and laterally translatable between the receiving sockets 16 of the female receptacle 18.

While all of the fundamental characteristics and features of the Electrical Plug with Trigger Activated Ejection System herein disclosed have been shown and described, it should be understood that various substitutions, modifications, and variations may be made by those skilled in the art without departing from the spirit or scope of the invention. Consequently, all such modifications and variations are included within the scope of the invention.

What is claimed is:

1. A user triggered ejecting system for use in combination with an electrical plug attached to a cord, which cooperatively engages an electrical socket having receiving sockets communicating with a receiving face, comprising:

a plug component, said plug component having a body portion and at least one electrical pin extending from a pin face on said body portion, each pin sized to frictionally engage one of said receiving sockets, each pin located to register with one receiving socket;

said plug component and said electrical socket having an engaged position with said electrical pins cooperatively engaged with said receiving sockets and said pin face portion adjacent to said receiving face;

said plug component and said electrical socket having a separated position wherein said receiving sockets are not engaged with said electrical pins;

an ejection system, said ejection system mounted inside said plug component;

said ejection system having a trigger rotationally mounted upon a pivot;

said ejection system having a laterally translatable rod, said rod having a first end communicating with an attachment end of said trigger and having a second end opposite said first end;

said rod laterally translatable toward said pins by movement of an activation end of said trigger opposite attachment end thereby causing said distal end of said rod to translate from a retracted position inside said body to an extended position protruding from said pin face of said plug component, whereby said plug component and said socket component are forced from said engaged position to said separated position by movement of said activation end of said trigger.

2. The user triggered ejecting system of claim 1 additionally comprising a biasing means, said biasing means communicating a calculated bias to said rod thereby biasing said distal end of said rod to said retracted position.

3. The user triggered ejecting system of claim 1 additionally comprising:

said plug component having a receptacle face, opposite said pin face;

said receptacle face, having plug receiving sockets communicating with a said receptacle face;

said plug receiving sockets operatively communicating with respective pins on said pin face, whereby said receptacle face will accommodate a cord plug with pins extending therefrom in positions to frictionally engage with said plug receiving sockets.

4. The user triggered ejecting system of claim 3 wherein said extended position of said rod is protruding from said receptacle face of said plug component, whereby said plug component and said chord plug are forced from said engaged position to said separated position by movement of said activation end of said trigger.

5. The user triggered ejecting system of claim 2 additionally comprising:

said plug component having a receptacle face, opposite said pin face;

said receptacle face, having plug receiving sockets communicating with a said receptacle face;

said plug receiving sockets operatively communicating with respective pins on said pin face, whereby said receptacle face will accommodate a chord plug with pins extending therefrom in positions to frictionally engage with said plug receiving sockets.

6. The user triggered ejecting system of claim 2 wherein said extended position of said rod is protruding from said receptacle face of said plug component, whereby said plug component and said chord plug are forced from said engaged position to said separated position by movement of said activation end of said trigger.

7. A user triggered ejecting system for cooperative interface between an electrical plug having one or a plurality of pins extending therefrom communicating with wires in a cord, and a receiving socket having pin receiving sockets configured to frictionally engage said plurality of pins extending from said electrical plug, comprising:

an interface component, said interface component having a body portion and at least one electrical pin extending from a pin face on said body portion, each pin sized to frictionally engage one of said receiving sockets, each pin located to register with one receiving socket located in a receptacle;

said plug component having a receptacle face, opposite said pin face;

said receptacle face, having plug receiving sockets communicating with said receptacle face;

said plug receiving sockets operatively communicating with respective pins on said pin face;

an ejection system, said ejection system mounted inside said interface component;

said ejection system having a trigger rotationally mounted upon a upon a pivot;

said ejection system having a laterally translatable rod, said rod having a first end communicating with an attachment end of said trigger and having a second end opposite said first end;

said rod laterally translatable toward one of said pins or said plug receiving sockets by movement of an activation end of said trigger opposite attachment end thereby causing said distal end of said rod to translate from a retracted position inside said body to an extended position protruding from one of said pin face or said receptacle face of said plug component thereby separating said interface component from frictional engagement.

8. The user triggered ejecting system of claim 1 additionally comprising:

said body portion having a center axis therethrough; and said rod laterally translatable substantially on said center axis.

9. The user triggered ejecting system of claim 3 additionally comprising:

said body portion having a center axis therethrough; and said rod laterally translatable substantially on said center axis.

10. The user triggered ejecting system of claim 7 additionally comprising:

said interface component having a center axis therethrough; and said rod laterally translatable substantially on said center axis.

* * * * *